US009926924B2

(12) United States Patent
Bezze et al.

(10) Patent No.: US 9,926,924 B2
(45) Date of Patent: Mar. 27, 2018

(54) SYSTEM FOR MANAGING A VEHICLE COMPRESSOR

(71) Applicant: Iveco S.P.A., Turin (IT)

(72) Inventors: Massimo Bezze, San Benigno Canavese (IT); Claudio Prina, Biella (IT)

(73) Assignee: Iveco S.p.A., Turin (IT)

( * ) Notice: Subject to any disclaimer, the term of this patent is extended or adjusted under 35 U.S.C. 154(b) by 557 days.

(21) Appl. No.: 14/248,044

(22) Filed: Apr. 8, 2014

(65) Prior Publication Data

US 2015/0285240 A1 Oct. 8, 2015

(51) Int. Cl.

| | |
|---|---|
| ***F04B 39/06*** | (2006.01) |
| ***F04B 17/05*** | (2006.01) |
| ***F04B 49/06*** | (2006.01) |
| ***F04B 49/10*** | (2006.01) |

(52) U.S. Cl.

CPC ..... *F04B 49/065* (2013.01); *F04B 17/05* (2013.01); *F04B 39/06* (2013.01); *F04B 49/103* (2013.01)

(58) Field of Classification Search

CPC ..... F04B 49/09; F04B 49/065; F04B 49/103; F04B 17/05

USPC ..... 700/281; 417/281, 293

See application file for complete search history.

(56) References Cited

U.S. PATENT DOCUMENTS 2,277,135 A * 3/1942 Newell ..... F04B 49/103 417/218
4,737,079 A * 4/1988 Kurosawa ..... F04B 27/1804 417/222.2
4,969,334 A * 11/1990 Goubeaux ..... F04B 49/103 417/212
5,820,352 A * 10/1998 Gunn ..... F04B 39/16 417/26
6,394,758 B1 * 5/2002 Lee ..... F04B 49/065 417/13
7,062,366 B2 * 6/2006 Dussapt ..... F04B 49/022 701/100
8,467,950 B1 * 6/2013 Pfefferl ..... B60T 17/02 123/339.17
8,512,007 B2 * 8/2013 Hebrard ..... B60T 17/02 417/223
8,532,887 B2 * 9/2013 Moriyama ..... F16D 48/066 417/281
2003/0097849 A1 * 5/2003 Taguchi ..... B60H 1/3225 62/133

(Continued)

FOREIGN PATENT DOCUMENTS

DE 10215392 4/2003
DE 102008005428 7/2009

(Continued)

OTHER PUBLICATIONS

Office Action relating to corresponding Russian Patent Application No. 2013152460; dated Dec. 10, 2017; 8 pages.

*Primary Examiner* — Jason D Mitchell
(74) *Attorney, Agent, or Firm* — Stetina Brunda Garred and Brucker

(57) ABSTRACT

System for managing a vehicle compressor, wherein the compressor (C) is driven in rotation by a vehicle engine (E). The system varies a stop pressure threshold (cut-off threshold) of the compressor as an inverse function of a compressor speed of rotation. The compressor speed of rotation is directly proportional to the vehicle engine speed of rotation (E).

8 Claims, 1 Drawing Sheet

(56) References Cited

U.S. PATENT DOCUMENTS

| | | | | |
|---|---|---|---|---|
| 2006/0048531 | A1* | 3/2006 | Eisenhour | B60H 1/3208 62/228.3 |
| 2006/0067837 | A1* | 3/2006 | Kanou | F04B 49/103 417/269 |
| 2006/0196168 | A1* | 9/2006 | Seitz | B60T 17/02 60/278 |
| 2008/0173033 | A1* | 7/2008 | Colavincenzo | B60T 17/02 62/133 |
| 2008/0229767 | A1* | 9/2008 | Nakamura | B60H 1/3205 62/133 |
| 2009/0013688 | A1* | 1/2009 | Panciroli | F02B 37/16 60/602 |
| 2011/0231047 | A1* | 9/2011 | Aixala | B60T 17/02 701/22 |
| 2011/0287893 | A1 | 11/2011 | Mueller et al. | |
| 2012/0316713 | A1* | 12/2012 | Pfefferl | F04C 28/06 701/22 |
| 2013/0172138 | A1* | 7/2013 | Sega | B60K 25/02 474/148 |
| 2013/0204490 | A1* | 8/2013 | Pfefferl | B60T 17/02 701/36 |
| 2014/0174112 | A1* | 6/2014 | Molavi | F25B 31/004 62/84 |

FOREIGN PATENT DOCUMENTS

| | | | | |
|---|---|---|---|---|
| EP | 0469615 | A1 | 2/1992 | |
| EP | 2735484 | * | 5/2014 | |
| EP | 2735484 | A1 * | 5/2014 | B60T 17/02 |

* cited by examiner

SYSTEM FOR MANAGING A VEHICLE COMPRESSOR

CROSS REFERENCE TO RELATED APPLICATIONS

Not Applicable.

STATEMENT RE: FEDERALLY SPONSORED RESEARCH/DEVELOPMENT

Not Applicable.

BACKGROUND OF THE INVENTION

Field of the Invention

The present invention refers to the field of the systems for managing vehicle compressors, which generally equip vehicles having a pneumatic braking system and/or pneumatic suspensions.

State of the Art

The vehicle compressor is generally controlled by a pressure sensor which measures the pressure of the compressed air within suitable accumulation tanks.

The calibration of the cut-off value, namely the pressure value measured in the tanks that determines the compressor stopping, is crucial in relation to the dimensions of the tanks, in order to cope with all the needs of the case, namely, for example, the need of lifting the suspensions, of activating an additional axle or of performing numerous braking repetitions.

A high number of pneumatic activations and an intense use of the pneumatic system may bring to determine a very high cut-off threshold.

Thus, in general, the cut-off value is identified at the planning stage.

Problems connected to the overheating of the compressor head when the vehicle engine runs at a high speed are known in the art.

The compressor, indeed, is mechanically connected to the internal combustion engine and takes from the latter the energy that is necessary to compress the air.

The energy absorption by the compressor is proportional to the number of revolutions per minute at which it is driven in rotation. This means that the activation of the compressor when the vehicle travels at a high speed, namely with a high engine speed, determines the maximum possible energy absorption by the compressor which tends to recharge the tanks in a very short time. This results in an overheating of the compressor head and in an overall worsening of the system engine/compressor, since the engine is asked to face by itself a high air resistance and since there is also a reduction of the volumetric efficiency of the compressor.

When the head of the compressor becomes particularly hot, the lubricating oil, which is generally in common with the internal combustion engine, tends to burn, worsening the performance of the compressor itself and of the post-treatment system of the compressed air. Moreover, the oil itself may leak, due to the high temperatures, and contaminate the post-treatment system of the compressed air and the whole compressed air circuit.

Furthermore, at the planning stage, it is necessary to appropriately dimension the pipes of the compressed air, in order to cool the air that passes through the post-treatment system. This means that suitable heat exchange elements and particularly long pipes for compressed air have to be provided, in order to take into account the temperature of the air sent by the compressor, also at the highest speed of rotation.

Furthermore, the stress of the elements forming the compressor is influenced by the back pressure in output from the compressor itself, thus with a high speed of rotation, such stress increases, increasing the wear of the compressor increases.

SUMMARY OF THE INVENTION

Therefore the aim of the present invention is to overcome all the drawbacks of the prior art showing a system for managing a vehicle compressor allowing to reduce the negative effects due to the overheating of the head of the compressor.

The object of the present invention is a method for managing a vehicle compressor, in accordance with claim 1.

Thanks to the present invention, it is possible to noticeably reduce the temperature level reached at the head of the compressor, and to achieve all the consequent effects in relation to the lubricating oil. Furthermore it is possible to provide shorter delivery pipes and accumulation tanks of the compressed air, especially of the secondary services and of the suspensions, which are smaller, cheaper and less cumbersome.

Preferred embodiments of the invention will be described more fully in the claims, which are an integral part of the present description.

BRIEF DESCRIPTION OF THE DRAWINGS

Further purposes and advantages of the present invention will become clear from the following detailed description of a preferred embodiment (and of its alternative embodiments) and the drawings that are attached hereto, which are merely illustrative and non-limitative, in which.

In the figures the same reference numbers and letters identify the same elements or components.

DETAILED DESCRIPTION OF THE INVENTION

The method that is object of the invention is now described in detail.

According to the present invention, a cut-off threshold indicates the pressure detected substantially within the compressed air tanks which determines the compressor stopping; while a cut-in threshold indicates the pressure detected substantially within the compressed air tanks which determines the activation of the charging operation of the compressor.

According to the present invention, at least one of said cut-off and possibly cut-in thresholds is varied as an inverse function of the revolutions per minute of the engine.

Here the engine E speed of rotation and the compressor C speed of rotation are the same, since the latter is driven by the former with a constant or controllable gear ratio.

Thus the compressor speed of rotation is always proportional to the engine speed of rotation.

Figure 1:
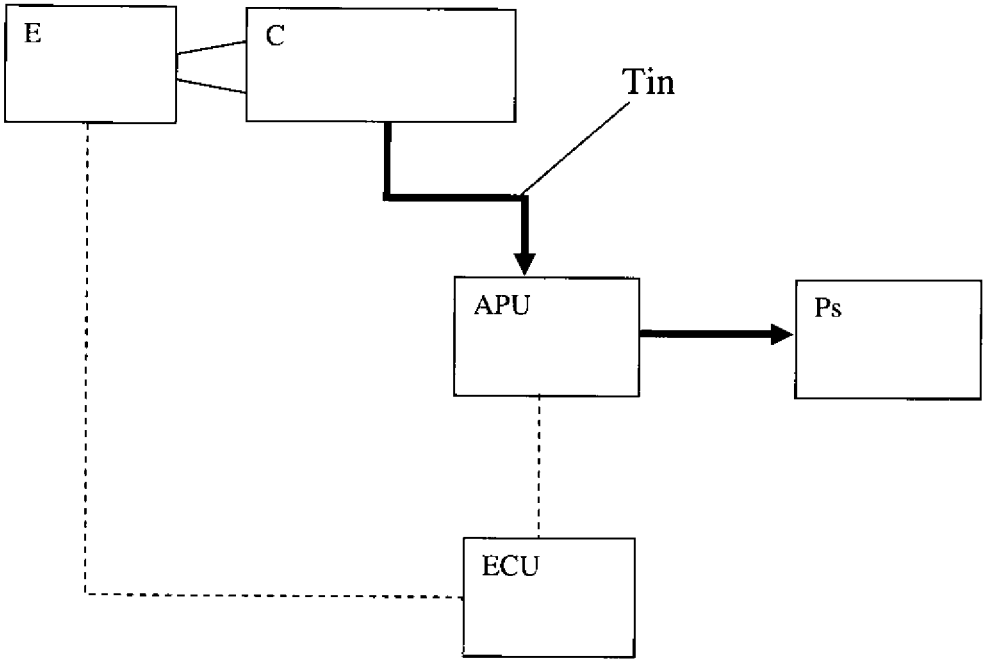
FIG. 1 shows a logic diagram of the components involved in the embodiment of the present invention.

With reference to FIG. 1, it can be observed that compressor C can be mechanically connected to the internal combustion engine E from which it receives mechanical energy.

The delivery pipe Tin pneumatically connects the compressor to the treatment unit of the compressed air APU. According to a preferred alternative embodiment of the invention, such unit dries the compressed air and manages the activation and deactivation of the compressor C.

Such unit is connected to and in communication with the engine control unit ECU, thus the unit APU varies, by itself or under the control of the engine control unit ECU, one of said cut-off and possibly cut-in thresholds as an inverse function of the engine revolutions per minute, which is a data that is constantly available to the engine control unit ECU.

According to a preferred alternative embodiment of the present invention, when the internal combustion engine runs at a speed lower than 1000 rpm, the cut-off threshold is set at 13 bars and the cut-in threshold is set at 11 bars.

On the contrary, when the internal combustion engine runs at a speed higher than 1000 rpm, the cut-off threshold is set at 10 bars and the cut-in threshold is set at 9 bars.

According to such alternative embodiment both thresholds are varied.

The reduction of the cut-off pressure at a high speed of rotation allows to stop beforehand the charging operation of the compressor, limiting the overheating of the head of the compressor. Since there is less energy stored in the tanks, more frequent, but shorter, starting cycles of the compressor are expected.

When the cut-off threshold is lowered, in order to avoid that the cut-off/cut-in thresholds are too near causing the compressor to start too frequently and to work for a too short time, also the cut-in threshold can be varied, in order to have at least 1 bar of hysteresis, namely of difference between the thresholds, between starting and stopping.

Advantageously, when the engine runs at a high speed of rotation, namely when the vehicle travels at a high speed, the need for changing the trim of the suspensions or for activating an axle is unlikely. Thus, accumulating less energy with a lower cut-off and possibly cut-in threshold is absolutely compatible with a lower absorption of the same pneumatic energy.

On the contrary, when the vehicle is stationary or travels very slowly it is more probably subjected to pneumatic energy absorptions, thus a higher cut-off value is compatible with such usage condition. Moreover, since the engine runs at a low speed of rotation, the aforementioned problems of compressor head overheating are not present.

When the vehicle travels downhill and it is subjected to an intense braking cycle, the engine brake tends to increase the engine speed of rotation, thus the cut-off and possibly cut-in threshold, could be reduced, in accordance with the present invention. This does not result in a problems, since in such conditions the charging time of the tanks are very short, thanks to the high speed of rotation of the engine.

According to a preferred alternative embodiment of the invention, such cut-off and/or cut-in thresholds may be varied also as an inverse function of the environmental temperature, which clearly influences the heating of the compressor head, and as am inverse function of the lubricating oil temperature, which can be measured directly or indirectly by means of the temperature of the cooling fluid of the internal combustion engine E.

The present method is performed continuously, until the vehicle engine is working.

Figure 2:
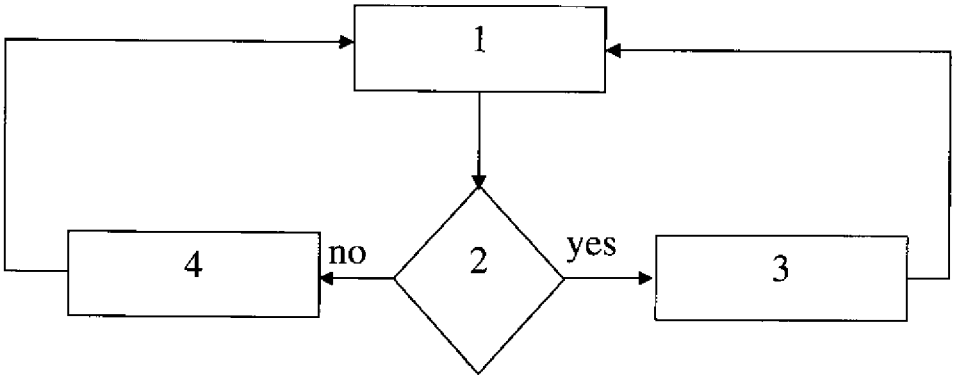
FIG. 2 shows an example of block diagram defining a preferred embodiment of the method of the present invention.

FIG. 2 shows a block diagrams exemplifying the present invention:

(step 1) acquisition of a speed of rotation of the compressor C or engine E, (step 2) if said speed is higher than a predetermined threshold, then (step 3) set the cut-off threshold at 10 bars and the cut-in threshold at 9 bars and go back to the beginning, (step 4) on the contrary, if said speed is NOT higher than said predetermined threshold, then set the cut-off threshold at 13 bars and the cut-in threshold at 11 bars and go back to the beginning.

The present invention may be realized by means of the vehicle control unit, possibly providing a suitable programming of the latter.

Thus, the present invention may advantageously be realized by means of a computer program, which comprises program code means performing one or more steps of said method, when said program is run on a computer. For this reason the scope of the present patent is meant to cover also said computer program and the computer-readable means that comprise a recorded message, such computer-readable means comprising the program code means for performing one or more steps of such method, when such program is run on a computer.

It will be apparent to the person skilled in the art that other alternative embodiments of the invention can be conceived and reduced to practice without departing from the scope of the invention.

From the description set forth above it will be possible for the person skilled in the art to embody the invention with no need of describing further construction details. The elements and the characteristics described in the different preferred embodiments may be combined without departing from the scope of the present application.

What is claimed is:

1. A method for managing a vehicle compressor, the compressor being driven in rotation by a vehicle engine, the method comprising:

varying the stop pressure threshold of the compressor as an inverse function of a compressor speed of rotation irrespective of whether the vehicle engine is subject to engine braking; and varying a start pressure threshold of the compressor as an inverse function of a compressor speed of rotation irrespective of whether the vehicle engine is subject to engine braking;

wherein said compressor speed of rotation is calculated according to the vehicle engine speed of rotation; and wherein said stop pressure threshold and/or said start pressure threshold of the compressor varies as an inverse function of an environmental temperature.

2. The method according to claim 1, wherein said stop pressure threshold and/or said start pressure threshold of the compressor varies as an inverse function of a temperature of the lubricating oil of the compressor.

3. The method according to claim 2, wherein said lubricating oil is in common with the vehicle engine and said temperature of the lubricating oil is measured directly or by means of a temperature of a cooling fluid of said vehicle engine.

4. The method according to claim 1, comprising the following steps:

acquisition of a speed of rotation of the compressor or engine, if said speed is higher than a predetermined threshold, then set said stop pressure threshold at 10 bars and the said start pressure threshold at 9 bars and go back to the beginning, on the contrary, if said speed is NOT higher than said predetermined threshold, then set said stop pressure threshold at 13 bars and said start pressure threshold at 11 bars and go back to the beginning.

5. A device for managing the vehicle compressor, the compressor being driven in rotation by a vehicle engine, the device comprising:

control means for varying the stop pressure threshold of the compressor as an inverse function of a compressor speed of rotation irrespective of whether the vehicle engine is subject to engine braking; and means for varying a start pressure threshold of the compressor as an inverse function of a compressor speed of rotation irrespective of whether the vehicle engine is subject to engine braking;

wherein said compressor speed of rotation is calculated according to the vehicle engine speed of rotation; and wherein said stop pressure threshold and/or said start pressure threshold of the compressor varies as an inverse function of an environmental temperature.

6. The device according to claim 5, wherein said stop pressure threshold and/or said start pressure threshold of the compressor are varied as an inverse function of a temperature of the lubricating oil of the compressor.

7. The device according to claim 6, wherein said lubricating oil is in common with the vehicle engine and said temperature of the lubricating oil is measured directly or by means of a temperature of a cooling fluid of said vehicle engine.

8. The device according to claim 5, wherein said control means are configured for performing:

acquisition of a speed of rotation of the compressor or engine, if said speed is higher than a predetermined threshold, then set said stop pressure threshold at 10 bars and the said start pressure threshold at 9 bars and go back to the beginning, on the contrary, if said speed is NOT higher than said predetermined threshold, then set said stop pressure threshold at 13 bars and said start pressure threshold at 11 bars and go back to the beginning.

* * * * *